US005913797A

United States Patent [19]

Saleh

[11] Patent Number: 5,913,797

[45] Date of Patent: Jun. 22, 1999

[54] METHOD AND APPARATUS OF COLLECTING A TEXTILE TOW IN A CONTAINER

[76] Inventor: Lotfy L. Saleh, 7809 Ritter Dr., Charlotte, N.C. 28270

[21] Appl. No.: 08/847,067

[22] Filed: May 1, 1997

[51] Int. Cl.[6] ..... B65B 63/04

[52] U.S. Cl. ..... 53/429; 53/473; 53/116; 53/243; 19/160; 19/163; 28/289; 28/219

[58] Field of Search ..... 53/429, 116, 430, 53/473, 248; 28/219, 282, 289; 19/160, 163

[56] References Cited

U.S. PATENT DOCUMENTS

| | | | |
|---|---|---|---|
| 2,683,500 | 7/1954 | Goodloe | 53/429 |
| 2,719,351 | 10/1955 | Drummond | 53/429 |
| 2,971,244 | 2/1961 | Foller | 53/116 |
| 3,423,807 | 1/1969 | Couturier | 53/116 |
| 4,013,433 | 3/1977 | Briar | 28/289 |
| 4,276,682 | 7/1981 | Ruber | 28/289 |
| 4,422,225 | 12/1983 | Kurzke | 28/289 |
| 4,609,449 | 9/1986 | Morin | 204/206 |
| 5,149,332 | 9/1992 | Walton et al. | 604/358 |

*Primary Examiner*—John Sipos
*Assistant Examiner*—James P. Calve
*Attorney, Agent, or Firm*—Gregory N. Clements; Walter M. Douglas

[57] ABSTRACT

In the canning of tow produced by a synthetic textile filament extrusion line, a pair of deflecting rolls having radially projecting spokes are positioned immediately above the tow-receiving can for travel of the tow between the rolls to impose a folding or plaiting of the tow as it is deposited into the can, thereby reducing the linear velocity of the tow to mitigate potential entanglement of the tow within the can. The production output and operational speed of the filament extrusion process may thus be optimized without being limited by the downstream canning operation.

14 Claims, 3 Drawing Sheets

METHOD AND APPARATUS OF COLLECTING A TEXTILE TOW IN A CONTAINER

BACKGROUND OF THE INVENTION

The present invention relates generally to the extrusion of synthetic polymeric material into filaments for use in textile manufacture and, more particularly, to the collection of a tow of multiple extruded filaments into a container in preparation for subsequent filament processing.

In the conventional manufacture of synthetic textile yarns, a molten polymeric material is extruded in the form of multiple continuous filaments which, after quenching to cool the filaments below their glass transition temperature, are gathered and transported longitudinally in a lengthwise coextensive bundle commonly referred to as a tow. A driven take-up unit disposed downstream of the extruding apparatus delivers the tow at a controlled transport speed to a so-called canning station at which the tow is deposited into an open-top can or like container for storage pending further processing. In a typical subsequent drawing operation, the tows from a plurality of thusly filled cans are placed in a common creel for delivery and processing in side-by-side parallel warp sheet form through a draw frame to subject the tows simultaneously to a stretching and heat setting operation to orient the molecular structure of each constituent filament in each tow.

Conventionally, the process of extruding filaments and forming tow therefrom and the downstream canning of the tow require a relatively significant overall vertical elevation to allow for downward extrusion of the filaments and subsequent downward depositing of the tow into cans. Accordingly, for considerations of efficient use of manufacturing space, the extrusion of filaments and formation thereof into tow is commonly carried out on an upper floor of the manufacturing plant, with the take-up unit being positioned on such floor to deliver the tow downwardly to the canning station on the floor immediately therebelow. A pair of driven so-called sunflower wheels are commonly utilized immediately following the take-up unit to provide controlled delivery of the tow downwardly to the canning station, the sunflower wheels conventionally being the last components to physically contact the tow prior to being deposited into a can. The sunflower wheels basically comprise cylindrical rolls having a plurality of rounded tooth-like protrusions equally spaced about their respected peripheries, with the wheels arranged in parallel spaced relation and independently driven for sufficiently close meshing of the protrusions without direct contact thereof to effect a gripping mode of transport of the tow downwardly to the canning station at the floor below without damaging the tow.

Precise control of the canning operation is critical to ensure the tow is deposited uniformly from one can to another and also uniformly within each given can, so that each filled can contains precisely the same mass of tow and to promote reliable and consistent withdrawal of the tow from each can. For this purpose, the tow cans are fabricated preferably of a rectangular cross-section and are supported at the canning station on a platform controlled to move back and forth in a first "x" direction a distance equivalent to the width of the can and to move indexably in a perpendicular "y" direction by a distance equivalent to the cross-sectional diameter of the tow at the completion of each movement in the "x" direction. In this manner, the canning station serves to lay the tow within the can in a serpentine fashion precisely across the full width and length of the can and to progressively build rows and layers of the tow in such manner until a predetermined mass of tow has been deposited.

Within limits, this tow canning process has proven to be reasonably effective and reliable for the described purpose. However, as the textile industry continually strives to improve efficiency and reduce manufacturing costs, much effort has been devoted to attempts to increase the number of filaments bundled in each tow and to increase the lineal speed at which the filaments are extruded and transported to the canning station. The attendant corresponding increase in the mass and momentum of the traveling tow as it is deposited into a can at the canning station tends to cause the incoming tow to impinge with sufficient force on previous layers to make it difficult and sometimes impossible to maintain the tow in precise serpentine rows and layers as intended. As a result, it has been found in practice that the tow in adjacent rows and layers can become entangled and, in turn, problems are experienced in withdrawing the tow from the can in subsequent process operations, e.g., at the draw frame. At such higher linear traveling speeds, the tow can also experience undesired deviations from its intended compact cross-sectional shape as a result of a tendency of the individual constituent filaments to flair or otherwise separate from one another over the final segment of its path of travel into the can during which the tow travels essentially unconfined through an open air space. Likewise, since the textile industry has similarly sought to progressively increase the operating speed of draw frames, the tows must be withdrawn from the cans in the draw frame creel at correspondingly increasing speeds, which can additionally aggravate entanglements in the tows.

Such tangles may often be manifested as a knot in the traveling tow, which will normally actuate stop motion detectors in the draw frame, causing the drawing operation to stop until an operator can manually intervene to disentangle the knotted tow. As will be appreciated, not only does such a stoppage of the drawing operation reduce the overall efficiency of the manufacturing operation, stoppages of the draw frame inherently pose the risk of localized overheating and attendant damage to the tows across the entire warp sheet. Furthermore, smaller knots or tangles in the tow which go undetected within the draw frame can cause even more severe problems in subsequent operations. For example, it is common to transport the warp sheet of drawn and heat-set tows exiting the draw frame through a pair of highly pressurized nip rolls and therefrom into a crimping apparatus commonly referred to as a stuffer box. The pressure exerted by the nip rolls can reach a magnitude on the order of twenty tons of force applied to the warp sheet and, hence, even very small knots or tangles in the tows will be unable to pass between the nip rolls and accordingly can result in severe damage to the support bearings for the rolls.

To date, little development work is known to have been devoted to addressing these problems. Fleissner GmbH & Co. of Egelsbach, Germany, has proposed a modified form of sunflower wheel arrangement wherein the two wheels are equipped with multiple projecting plates replacing in number the normally rounded and more shallow conventional teeth-like projections to attempt to achieve the dual function of gripping and transporting the tow and simultaneously slowing its traveling speed by imposing a zig-zag folding motion laterally with respect to the tow. It is believed, however, that in practice this modified sunflower wheel arrangement has limited effectiveness in its potential for reducing the traveling speed of the tow due to the high number of contact points between the projecting plates of the modified sunflower wheel and the tow. Although the high number of contact points of the modified sunflower wheel design is required for gripping and ensuring the desired traveling speed of the tow, it has been known to exhibit a greater tendency to stretch the relatively delicate tow and create a greater risk of breaking individual filaments. While reasonably effective to prevent tangling of the tow when deposited into a can, the resultant damage to the tow renders the tow largely unusable.

SUMMARY OF THE INVENTION

It is accordingly a fundamental object of the present invention to provide a means and methodology of canning tow delivered from a filament extrusion operation at linear traveling speeds consistent with the current state of the art without experiencing the problems of entanglement and knotting described above. A more particular object of the present invention is to provide an improvement over the above-described sunflower wheel arrangement attempted unsuccessfully to address these problems. A further object of the present invention is to provide a means and methodology, separate and apart from a sunflower wheel arrangement, for slowing the traveling speed of the tow entering the canning station without the risk of mechanical damage to the tow or filaments. More specifically, it is an additional object of the invention to provide such a tow-slowing means and methodology which may be positioned in close proximity to a receiving can or other container at the canning station for effectively operating on the traveling tow immediately in advance of its entry into the can or container to minimize flaring of the tow caused by exposure to the surrounding air. Further objects, effects, and advantages of the present invention will be apparent from the specification hereinafter provided.

Briefly summarized, the foregoing objects are provided in the present invention by a novel method and apparatus for collecting a textile tow in a container wherein a motive force is applied to the tow by a first means or other arrangement to transport the tow in a longitudinal path of travel from a source of supply into the intended container and, intermediate the location at which the motive force is applied and the container, the longitudinal travel of the tow is regularly interrupted, by means of a second downstream arrangement to effectively slow the traveling speed of the tow sufficiently at its entry into the container to deter entanglement of the tow when deposited within the container.

In one preferred embodiment, the interruption of the longitudinal travel of the tow is accomplished by deflecting the tow at periodic intervals transversely of its path of travel, and most preferably by deflecting the tow alternatingly in opposing transverse directions immediately in advance of entry of the tow into the container. Generally, the tow deflecting means comprises a pair of deflecting devices disposed at opposite sides of the path of travel of the tow for alternatingly imposing opposed deflecting forces on the traveling tow. Further, such deflecting devices have a plurality of annularly spaced tow deflecting elements thereon.

The motive force for transporting the tow may be applied in any suitable manner of drivingly engaging the tow, preferably by means of a sunflower wheel arrangement of the conventional type described above. In a preferred arrangement for transversely deflecting the tow to interrupt and slow its path of travel, a pair of deflecting rolls are disposed in spaced non-contacting relation for rotation about parallel axes, with each roll having a plurality of annularly spaced radially projecting spokes or other suitable tow deflecting elements. An appropriate means is provided for driving the rolls synchronously to engage the tow alternately by the respective deflecting spokes of the tow rolls. Preferably, the axes of the rolls are spaced apart a distance greater than the radial dimension of the spokes to mitigate stretching and potentially damaging the tow.

DESCRIPTION OF THE PREFERRED EMBODIMENT

Figure 1:
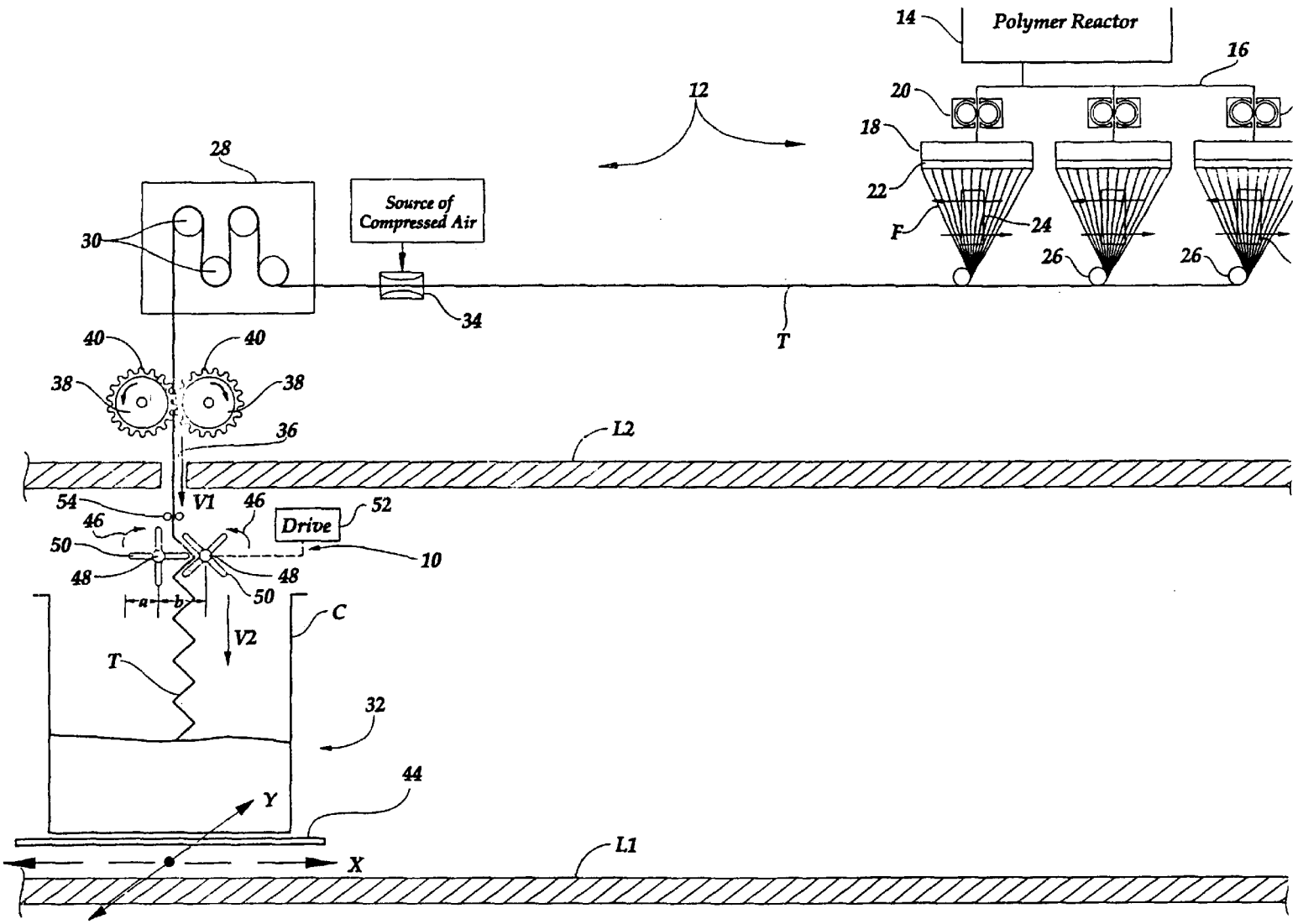
FIG. 1 is a schematic diagram illustrating a system for extruding and bundling a plurality of elongate continuous textile filaments into a tow and then collecting the tow into a container in accordance with the preferred embodiment of the present invention.

Referring now to the accompanying drawings and initially to FIG. 1, an arrangement in accordance with the preferred embodiment of the present invention for collecting a textile tow in a can or like container is indicated generally at 10 as preferably embodied at the end of a production line, generally indicated at 12, for extruding multiple elongate continuous synthetic textile filaments and bundling the filaments in coextensive side-by-side parallel relation in the form of a tow, indicated at T.

The tow production line 12 basically comprises a polymer reactor, indicated only schematically at 14, by which a molten polymer, such as polyester, is prepared and delivered through a system of feed conduits 16 to a plurality of extruders 18, commonly referred to as spinning units, through a corresponding plurality of gear pumps 20 which serve to provide a uniformly metered flow of the molten polymer into the spinning units 18. The spinning units 18 are commonly referred to as a "spin pack". For sake of simplicity, only three such spinning units 18 are depicted in the accompanying FIG. 1, but will be recognized and understood by persons skilled in the art that, in practice, substantially larger number of spinning units, e.g., between sixteen and twenty four units, will typically be provided. Each spinning unit 18 includes a spinnerette, indicated at 22, through which the molten polymer delivered under pressure from the associated gear pump 20 is extruded in elongate continuous filamentary form, as indicated by the filaments F.

The multiple filaments F from each spinning unit 18 are withdrawn downwardly along mutually converging paths moving past a quenching unit, indicated schematically at 24, to cool the filaments F sufficiently at least to reduce their temperature below the glass transition temperature of the polymer. The respective filaments F from the spinning units 18 are collected and diverted horizontally about respective deflection rolls 26 into a bundle, forming the tow T, to travel collectively in coextensive side-by-side parallel relation to a downstream take-up frame, shown schematically at 28. The take-up frame 28 comprises a series of synchronously driven capstan rolls 30 which serve to control the withdrawal speed of the tow T from the spinning units 18 and to provide the motive force for transporting the tow T to a downstream canning station 32, described more fully below. Immediately upstream of the take-up frame 28, the tow T is transported through a compaction jet device 34 which continuously applies a stream of compressed air radially inwardly to the traveling tow T to promote cohesiveness of the constituent individual filaments F.

As depicted in FIG. 1 and as explained above, the overall vertical distance required to accommodate the spinning units 18, the take-up frame 28 and the canning station 32, is typically greater than can reasonably be accommodated within a given level or floor in a typical manufacturing plant. Accordingly, it is common to position the canning station 32 on a separate level or floor of the manufacturing plant, as indicated at L1, immediately below the level or floor L2 on which the spinning units 18 and the take-up frame 28 are positioned, with the take-up frame being oriented to discharge the traveling tow T downwardly to the canning station 32 through a suitable opening 36 in the upper floor L2. Immediately above the floor opening 36, the tow T is transported between a pair of synchronously driven wheels 38 commonly referred to as sunflower wheels due to the corrugated peripheral surface configuration of the wheels resulting from rounded tooth-like projections 40 space about the periphery of each wheel. The sunflower wheels 38 are driven about parallel axes with their respective peripheries spaced sufficiently apart to prevent contact between their respective teeth 40 while still gripping the tow T between the wheels 38 to ensure controlled transport of the tow T vertically downwardly through the floor opening 36.

At the canning station 32 on the level L1 directly below the floor opening 36, a tow container C, typically of a rectangular horizontal cross-section with an open top, commonly referred to in the industry as a can, is supported on a platform 44 which is controllably movable by conventional means horizontally, i.e., normal to the vertical downward path of travel of the tow T, both along an "x" axis widthwise of the can and along a perpendicular "y" axis lengthwise of the can. In a known manner, the control means for driving the platform continuously executes reciprocating back-and-forth movements of the can C along the "x" axis by a distance equivalent to the interior widthwise dimension of the can and, at the completion of each widthwise reciprocation, indexes the platform progressively in one direction along the "y" axis until the platform 44 has been indexed a cumulative distance equivalent to the interior lengthwise dimension of the can C, whereupon the direction of the indexing movement along the "y" axis is reversed. As the can C correspondingly moves continually with such movements of the platform 44 along the "x" and "y" axes, the incoming tow T is caused to be laid in a serpentine or plaited back-and-forth manner across the full width and length of the interior of the can, progressively building layers of the tow T until a predetermined total mass of the tow T has been collected.

Figure 2:
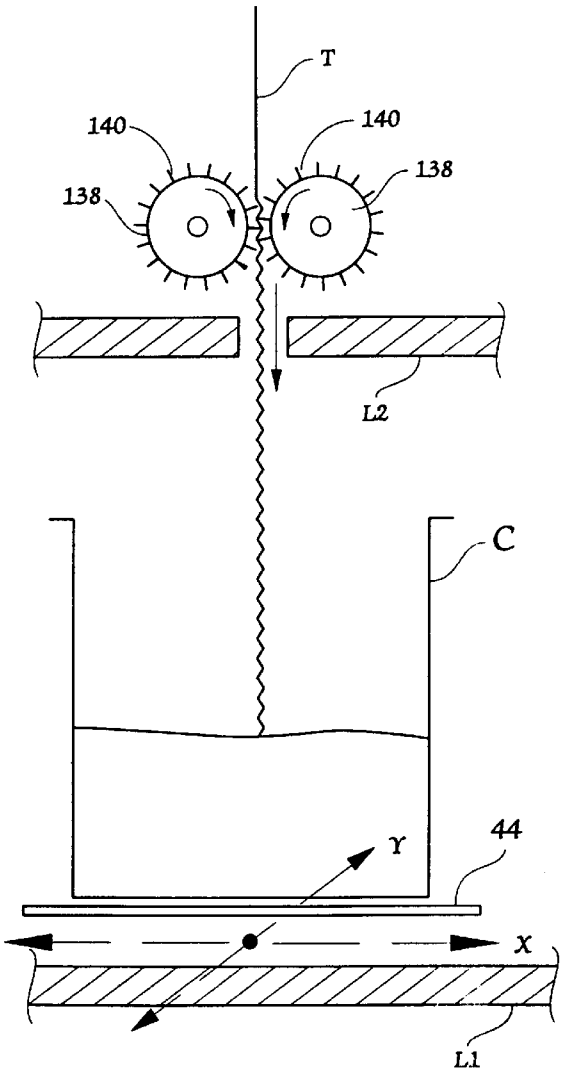
Fig. 2 (Prior Art)
FIG. 2 is a schematic diagram depicting a prior art tow handling apparatus.

As thus far described, the operation of the production line 12, including the canning station 32, is conventional and represents the basic type of tow producing system which is subject to the tow canning problems described above when operated at the higher processing speeds currently preferred for optimizing production efficiency, e.g., with the production line extruding polymer at a rate on the order of 120 kilograms per hour per spin pack position and with the tow traveling at speeds on the order of 1700 meters per minute. FIG. 2 depicts schematically a modified arrangement of the sunflowers wheels 138 proposed by Fleissner GmbH & Co. to address such problems, as already described above. Similarly to the conventional sunflower wheels 38 of FIG. 1, the modified sunflower wheels 138 each have a central cylindrical body generally comparable in diameter to the sunflower wheels 38 but, instead of the rounded corrugated form of shallow teeth 40 provided on the periphery of the sunflower wheels 38, the sunflower wheels 138 are equipped with narrow radially projecting pins or fingers 140. The sunflower wheels 138 are spaced sufficiently from one another for intermeshing of their respective pins 140 without physical contact therebetween, the intended purpose being to grip the tow T for downward transport into the can C therebelow while simultaneously slowing the traveling speed of the tow T by inducing the tow T to move in a sinuous path over the respective pins 140. As indicated above, experience and practice with such system has shown that the pins 140 tend to unacceptably damage the tow T with sufficient frequency to often render the tow T unusable.

In contrast, the tow collecting arrangement of the present invention as shown in FIG. 1 is based on the recognition that the functions of gripping and transporting the tow, as conventionally carried out by the sunflower wheels 38, and of deflecting or otherwise slowing the traveling speed of the tow T cannot reasonably be accomplished by the same operational arrangement but rather are optimally achieved by utilizing separate mechanisms or arrangements to accomplish such functions. Accordingly, under the present invention, a conventional pair of sunflower wheels 38 is utilized immediately downstream of the take-up frame 28, as depicted in FIG. 1, solely for the purpose of grippingly controlling the downward transport of the tow T into the can C without substantially affecting the linear traveling speed of the tow T. Under the present invention, the tow collecting arrangement 10 utilizes a separate pair of rotary deflecting rolls 46 disposed on the level L1 immediately above the open top of the can C to impose a folding or plaiting action on the downwardly traveling tow T as the tow is deposited into the can C, as more fully explained below.

As shown in FIG. 1, the deflecting rolls 46 are disposed in spaced side-by-side relation to rotate about parallel axes, each of the rolls 46 basically comprising a central axial shaft 48 from which a plurality of spokes 50 extend radially outwardly at equal circumferential spacings about the shaft 48. The shaft 48 of each roll 46 is of a substantially reduced diameter in comparison to the diameter of the main cylindrical body of the conventional sunflower wheels 38 disposed thereabove, while the spokes 50 have a substantially greater radial dimension than either the teeth 40 of the conventional sunflower wheels 38 or the pins 140 of the modified form of sunflower wheels 138 shown in FIG. 2. The axial shafts 48 of the rotary deflecting rolls 46 are spaced apart a dimension greater than the radial dimension of the spokes 50, but less than twice such radial dimension to insure overlapping of the spokes 50 of the respective rolls 46, and the rolls 46 are driven synchronously by a drive means shown only representatively at 52 with their respective spokes 50 staggered circumferentially, thereby to prevent contact between the spokes 50 of the respective rotary rolls 46.

In this manner, as the tow T travels downwardly between the two deflecting rolls 46, their respective spokes 50 periodically contact the tow T alternatingly to deflect the tow transversely, i.e., laterally, from its downward path of travel in laterally opposite directions, thereby regularly interrupting the longitudinal travel of the tow to slow its traveling speed as the tow T enters and is subsequently laid within the can C. As an ultimate result, the correspondingly reduced momentum of the tow T mitigates the otherwise conventional tendency of the tow T to impinge previously laid courses and layers of the tow T and thusly promotes and maintains the ordered layering of the tow T intended to be accomplished by the above-described X-Y motions executed by the can platform 44. Entanglements of the tow T are accordingly reduced or eliminated altogether and the tow T is more easily removed from the can C in subsequent operations with less tendency for tangling or knotting. To accentuate the folding action on the tow T imposed by the rotating spokes 50, the tow T is directed between a pair of closely spaced guide pins 54 immediately in advance of reaching the deflecting rolls 46, the guide pins 54 alternatingly providing fulcrum points for the folding action imposed by the spokes 50.

As will be appreciated by persons skilled in the art, the degree to which the traveling speed of the incoming tow T as received by the rotary deflecting rolls 46 is reduced downstream of the rolls 46 will depend upon several potential variables in the mechanical arrangement of the deflecting rolls 46. In accordance with the invention, it is highly preferred that the deflecting rolls 46 be driven at a constant axial speed (rpm) to effect a peripheral speed V2 at the ends of the respective spokes 50, which is lower than the incoming traveling speed of the tow T by an amount such that a minimum tow tension is maintained between the sunflower wheel and the deflecting rolls to have a straightening effect on the tow as it travels therebetween and such that the contact of the tow T by the spokes 50 does not produce excessive relative sliding movement or otherwise create friction therebetween. Thus, essentially the only effect of the spokes 50 is to deflect the tow T laterally without risk of damage to the tow T.

At a constant rotational speed of the rotary deflecting rolls 46 as thusly determined, the variables which will affect the tow-folding performance of the present invention will be the number of spokes 50 per deflecting roll 46, the radial dimension of the spokes 50, and the axial spacing between the two rolls 46. Thus, at a given incoming traveling speed of the tow T and a constant corresponding peripheral angular speed of the deflecting rolls 46, the reduction in the linear traveling speed of the tow T accomplished by the deflecting rolls 46 may in theory be expressed mathematically by the following equation:

$$\frac{V2}{V1} = \frac{\sin\left(\frac{360}{2n}\right)}{\left(\left[\sin\left(\frac{360}{2n}\right)\right]^2 + \left[2 - \frac{b}{a}\right]^2\right)^{1/2}}$$

wherein "V1" represents the original linear traveling speed of the incoming tow T, "V2" represents the reduced linear traveling speed of the folded tow T exiting the deflecting rolls 46, "n" represents the number of spokes 50 per roll 46, "a" represents the radial dimension of each spoke 50 measured from the rotational axes of the rolls 46, and "b" represents the spacing between the respective axes of the rolls 46.

As indicated, this mathematical expression is theoretical in that it does not account for any gravitational effect on the tow T nor any interaction by the surrounding air with the tow T. Likewise, the value V2 represents the velocity of the traveling tow T immediately as it exits the deflecting rolls 46. The actual velocity of the tow T at impact, i.e., placement, within the can C will depend on additional factors, particularly the vertical distance to be traveled downwardly from the rolls 46 to the particular elevation within the can C at which the tow T is being instantaneously placed. Subject, however, to such unquantifiable values, it will be understood by way of example that, at an incoming velocity of the tow T of 1,600 meters per minute, deflecting rolls 46 having eight spokes 50 of a radial dimension of 10.6 inches and spaced axially apart by a distance of 16.4 inches will effectively reduce the traveling speed of the tow T by approximately 35% to an exiting velocity V2 of 1,040 meters per minute.

As presently contemplated, it is believed that a minimum of four spokes 50 per deflecting roll 46 is preferred, essentially without regard to the radial dimension of the spokes 50. The optimal number of spokes 50 per roll 46 is expected to vary from one mechanical arrangement to another depending at least on the other variables discussed above. It is believed that a maximum of twenty spokes 50 per deflecting roll 46 is preferred.

Figure 3:
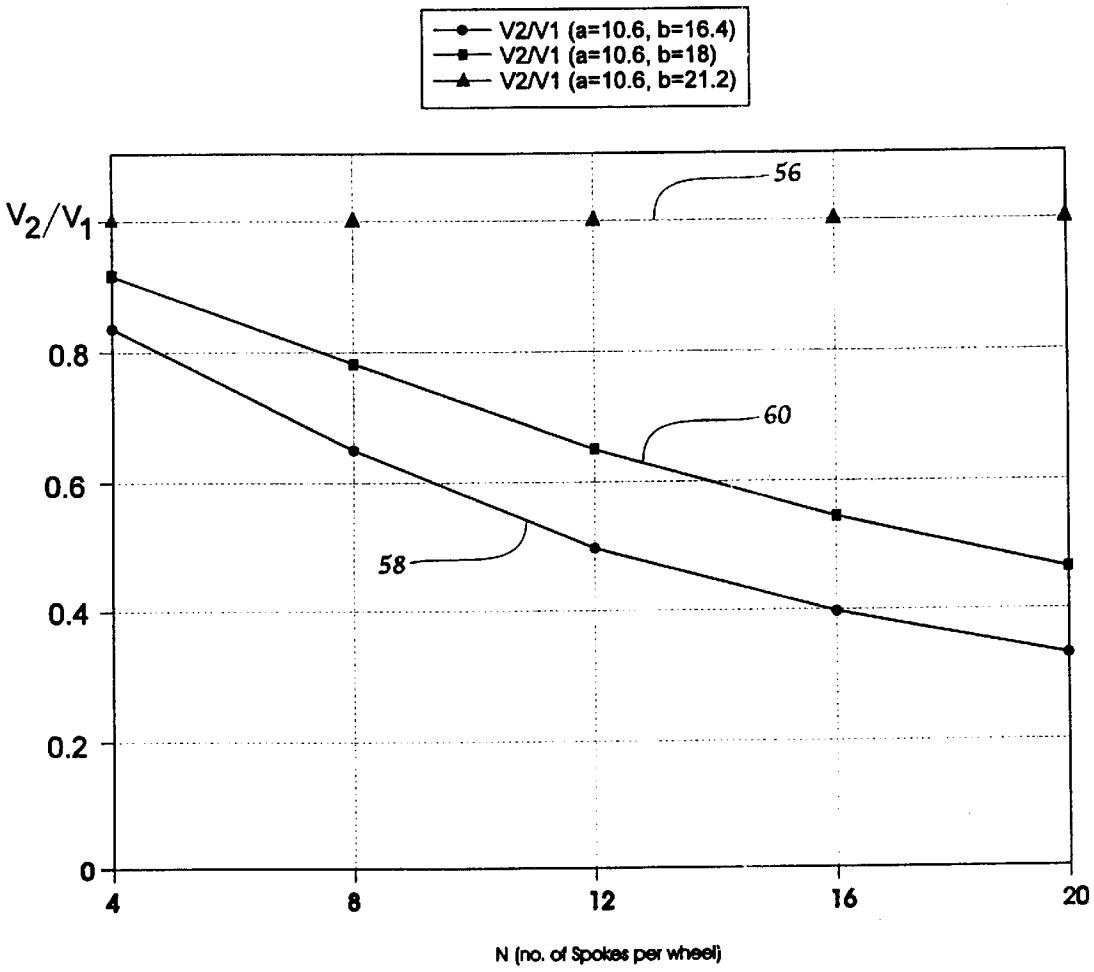
FIG. 3 is a graph illustrating the theoretical reduction in tow traveling speed accomplished by the present invention as a function of the number of spokes provided per deflecting roll.

By way of further example, the graph of FIG. 3 illustrates the theoretical relationship between the number of spokes 50 per deflecting roll 46 and the resultant reduction in tow velocity when other variables, particularly the radial dimension "a" of the spokes 50 and the axial spacing "b" between the rotary implements 46, remain constant. As will of course be recognized, if the axial spacing "b" between the deflecting rolls 46 is equal to or greater than twice the radial dimension "a" of the spokes 50, then the rolls 46 will impose no folding action on, and accordingly will have no effect in reducing the velocity of, the traveling tow T, as signified by the flat line 56. The curve 58 plotted in FIG. 3 represents the exemplary embodiment discussed above wherein the radial dimension "a" of the spokes 50 is 10.6 inches and the axial spacing "b" between the rolls 46 is 16.4 inches, this curve demonstrating that, as the number of spokes 50 is increased, a progressively greater reduction in tow velocity is accomplished in that, with the peripheral angular speed of the rolls 46 remaining constant, a greater number of spokes 50 per roll 46 interrupts the longitudinal travel of the tow T by imposing the aforedescribed folding action with greater frequency. Similarly, the curve 60 in FIG. 3 represents a modified embodiment of the present invention wherein, like the embodiment signified by the curve 58, the radial dimension "a" of the spokes 50 is still 10.6 inches but the axial spacing "b" between the rolls 46 is increased to 18 inches, this curve 60 illustrating that, as the spacing between the rolls 46 increases (other variables remaining unchanged), a lesser reduction in the traveling velocity of the tow T will be accomplished.

As the foregoing specification demonstrates, the present invention advantageously serves the ultimate goal of reducing the traveling speed of a tow T, without the risk of filament extension or frictional damage as the tow T enters a collection can C, whereby the tow T is deposited into the can C with sufficient gentleness that the tow T will be placed reliably in serpentine courses and vertical layers by the conventional operation of the can platform 44, with a substantially reduced incidence and tendency of the tow T to become entangled during the canning process. Thus, with the present invention, the canning operation will no longer impose a limitation on the desired maximization of the production output and operational speed of the filament extrusion and tow formation operation, thereby enabling the efficiency of such operation to be optimized.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of collecting a textile tow in a container, the method comprising the steps of applying a motive force to the tow for transporting the tow in a longitudinal path of travel from a source of supply into the container and, intermediate the location of applying the motive force and the container, grippingly controlling the downward movement of the tow by a pair of sunflower wheels, which engage and partially interrupt the longitudinal travel of said tow, and further downstream of said sunflower wheels regularly interrupting the longitudinal travel of the tow by a pair of rolls disposed in spaced non-contacting relation for rotation about parallel axes to slow the traveling speed of the tow at entry into the container, thereby to deter entanglement of the tow within the container;

wherein the axes of the rolls are in a plane perpendicular to the longitudinal travel direction of the tow and each of the rolls have a plurality of annularly spaced tow deflecting elements extending radially outward along said rolls for deflecting the tow transversely of the path of travel at periodic intervals.

2. A method of collecting a tow in a container according to claim 1, wherein the deflecting of the tow comprises deflecting the tow alternatingly in opposing directions transversely of the path of travel at periodic intervals.

3. A method of collecting a tow in a container according to claim 1, wherein the step of interrupting the longitudinal travel of the tow is performed immediately in advance of entry of the tow into the container.

4. A method of collecting a tow in a container according to claim 1 and further comprising the step of manipulating the container in a predetermined path of movement relative to the longitudinal travel of the tow for depositing the tow in regular layers in the container, the interrupting step being effective to deter entanglement of the layers with one another.

5. A method of collecting a tow in a container according to claim 1, wherein the step of applying a motive force for transporting the tow comprises drivingly engaging the tow.

6. Apparatus for collecting a textile tow in a container, the apparatus comprising means for applying a motive force to the tow for transporting the tow in a longitudinal path of travel from a source of supply into the container, and intermediate the location of applying the motive force and the container, a pair of sunflower wheels, which engage and partially interrupt the longitudinal travel of said tow and which grippingly control the downward movement of the tow, and further downstream of said pair of sunflower wheels, a pair of devices for regularly interrupting the longitudinal travel of the tow to slow the traveling speed of the tow at entry into the container, thereby to deter entanglement of the tow within the container;

wherein said devices are disposed in spaced non-contacting relation for rotation about parallel axes which are transverse to the longitudinal path of travel of the tow and each device has a plurality of annularly spaced tow deflecting elements extending radially outward along said device for deflecting the tow transversely of the path of travel.

7. Apparatus for collecting a textile tow in a container according to claim 6, wherein the deflecting devices deflect the tow alternatingly in opposing directions traversely of the path of travel at periodic intervals.

8. Apparatus for collecting a textile tow in a container according to claim 7, wherein the deflecting devices comprise a pair of rolls, each roll having a plurality of annularly spaced tow deflecting elements, and means for driving the rolls synchronously for engaging the tow alternating by the respective deflecting elements of the rolls.

9. Apparatus for collecting a textile tow in a container according to claim 8, wherein the axes of the rolls are spaced apart a distance greater than the radial dimension of the deflecting elements.

10. Apparatus for collecting a textile tow in a container according to claim 8, wherein each roll comprises at least four deflecting elements.

11. Apparatus for collecting a textile tow in a container according to claim 6, wherein the interrupting means is disposed immediately in advance of the container.

12. Apparatus for collecting a textile tow in a container according to claim 6 and further comprising means for manipulating the container in a predetermined path of movement relative to the longitudinal travel of the tow for depositing the tow in regular layers in the container.

13. Apparatus for collecting a textile tow in a container according to claim 6, wherein the force applying means comprises means for drivingly engaging the tow.

14. Apparatus for collecting a textile tow in a container according to claim 13, wherein the force applying means comprises a pair of driven wheels disposed at opposite sides of the path of travel of the tow.

* * * * *